US007077345B2

(12) United States Patent
Byram et al.

(10) Patent No.: US 7,077,345 B2
(45) Date of Patent: Jul. 18, 2006

(54) CONTROL OF A FEED SYSTEM OF A GRINDING MACHINE

(75) Inventors: Michael C. Byram, Pella, IA (US); Dennis K Gabler, Adel, IA (US); John A Carlson, New Sharon, IA (US)

(73) Assignee: Vermeer Manufacturing Company, Pella, IA (US)

( * ) Notice: Subject to any disclaimer, the term of this patent is extended or adjusted under 35 U.S.C. 154(b) by 176 days.

(21) Appl. No.: 10/319,392

(22) Filed: Dec. 12, 2002
(Under 37 CFR 1.47)

(65) Prior Publication Data

US 2004/0112999 A1 Jun. 17, 2004

(51) Int. Cl.
*B02C 25/00* (2006.01)

(52) U.S. Cl. ..... 241/35; 241/34

(58) Field of Classification Search ..... 241/34, 241/35, 186.35, 223
See application file for complete search history.

(56) References Cited

U.S. PATENT DOCUMENTS

| | | | | |
|---|---|---|---|---|
| 2,697,556 | A | 12/1954 | Turner | |
| 3,524,483 | A | 8/1970 | Smith | |
| 4,210,289 | A | 7/1980 | Arnoldy | |
| 4,598,745 | A | 7/1986 | Parviainen | |
| 4,865,094 | A | 9/1989 | Stroud et al. | |
| 5,020,579 | A | 6/1991 | Strong | |
| 5,088,532 | A | 2/1992 | Eggers et al. | |
| 5,230,475 | A | 7/1993 | Gerner | |
| 5,588,474 | A | 12/1996 | Egging | |
| 5,845,689 | A | 12/1998 | Egging et al. | |
| 5,881,959 | A | 3/1999 | Hazdjinian et al. | |
| 6,014,996 | A | 1/2000 | Egging et al. | |
| 6,230,770 | B1 | 5/2001 | Spaargaren | |
| 6,422,495 | B1 | 7/2002 | De Boef et al. | |
| 6,588,688 | B1 * | 7/2003 | Rossler | 241/35 |
| 6,769,248 | B1 * | 8/2004 | Giberson et al. | 60/338 |
| 2002/0070301 | A1 | 6/2002 | Stelter et al. | |

OTHER PUBLICATIONS

"CG7000 Tub Grinder Manual. Model F892-B," *Farmhand Inc.*, 13 pages (1993).
"HG3000 Tub Grinder. A high-capacity and easy-pulling grinder for 80-150 horsepower tractors," *Farmhand Inc.*, 4 pages (1993).
HG3000 Tub Grinder Manual, Model F880-E, *Farmhand Inc.*, 14 pages (1993).
"HG3040 Tub Grinder Manual. Model F880-F," *Farmhand Inc.*, 13 pages (1993).
"How to chop yard waste costs. 7000 Commercial Grinder," *Farmhand Inc.*, 4 pages (1993).
"Model V20, PC, SOL-I, EPC-I Solenoid-Controlled Directional Control Valve," 2 pages (Date Unknown).

* cited by examiner

*Primary Examiner*—Mark Rosenbaum
(74) *Attorney, Agent, or Firm*—Merchant & Gould P.C.

(57) ABSTRACT

A horizontal grinder is disclosed herein. The grinder includes a grinding structure and upper and lower feed conveyors for feeding material toward the grinding structure. The upper feed conveyor is positioned above the lower feed conveyor such that the material fed toward the grinding structure travels between the upper and lower feed conveyors. The grinder also includes a power source for rotating the grinding structure. A controller is provided for controlling the speed of at least one of the lower and upper feed conveyors in proportion to an operating characteristic of the power source.

23 Claims, 11 Drawing Sheets

1800 2000 2200

CONTROL OF A FEED SYSTEM OF A GRINDING MACHINE

FIELD OF TECHNOLOGY

The present invention relates generally to grinding machines for grinding wood and construction waste materials. More particularly, the present invention relates to a feed control system for grinding machines known as horizontal grinders.

BACKGROUND

Horizontal grinders have recently been developed for grinding a wide variety of materials including green wood waste and construction demolition. These machines include a feed system that is adapted to feed the wide variety of materials to a grinding unit which is adapted to effectively grind the materials and includes a feed conveyor and a feed roller. The grinding unit typically includes a grinding drum, which is rotated and includes hammers or blocks, and screens that hold material such that it will be forced into contact with the grinding drum until ground to a certain size.

The productivity of the grinding machines is related to the ability to control the feed system to deliver the material to the grinding drum at a rate equal to the capacity to grind. If the material is not delivered to the drum fast enough, the rate of grinding will be less than the potential. If the material is delivered too fast the material can become trapped between the grinding drum and the screens thereby increasing the risk of plugging. During normal grinding, the load on the grinding drum will typically increase in proportion to the rate at which material is being ground. When plugging begins, the load increases at a faster rate, and may reach an overload state. For grinders powered by diesel engines, the grinding unit may become plugged to the point the grinding drum will stop rotating, with material trapped between the grinding drum and the screens. This condition is undesirable, as it is difficult and time consuming to remedy. For grinders powered by electric motors the amperage draw may increase sharply, possibly damaging the motor or transmission components, or causing excessive power costs related to these spikes in electrical demand.

The overload condition can develop quickly. The feed systems are typically operated at a speed just below where the operator believes the machine may plug, in order to maximize productivity. Thus it can be difficult for an operator to control the feed system to avoid plugging. Systems have been developed to monitor for this overload condition, and subsequently automatically control the feed system. One such system is disclosed in U.S. Pat. No. 5,881,959, which describes a system that monitors for an overload condition of the grinding drum or of the feed system. If such a condition is detected, the feed system is stopped and can be reversed to correct the overload condition.

SUMMARY

The present invention provides a control system for a grinder to automatically control the elements of the feed system to maximize productivity of the grinding machine. The productivity of the grinding machine can be estimated by measuring the load condition, the amount of power that is being utilized. If very little power is being utilized, the productivity is known to be low. If the amount of power being utilized is approaching the maximum available, then the productivity will be close to maximum.

In one embodiment the speed of the feed conveyor is controlled in order to achieve a desired load condition. In another embodiment the speed of the feed roller is controlled to achieve a desired load condition. In a third embodiment the speed of both the feed rollers and the feed conveyor are controlled, independently, to achieve a desired load condition.

DETAILED DESCRIPTION

Figure 1:
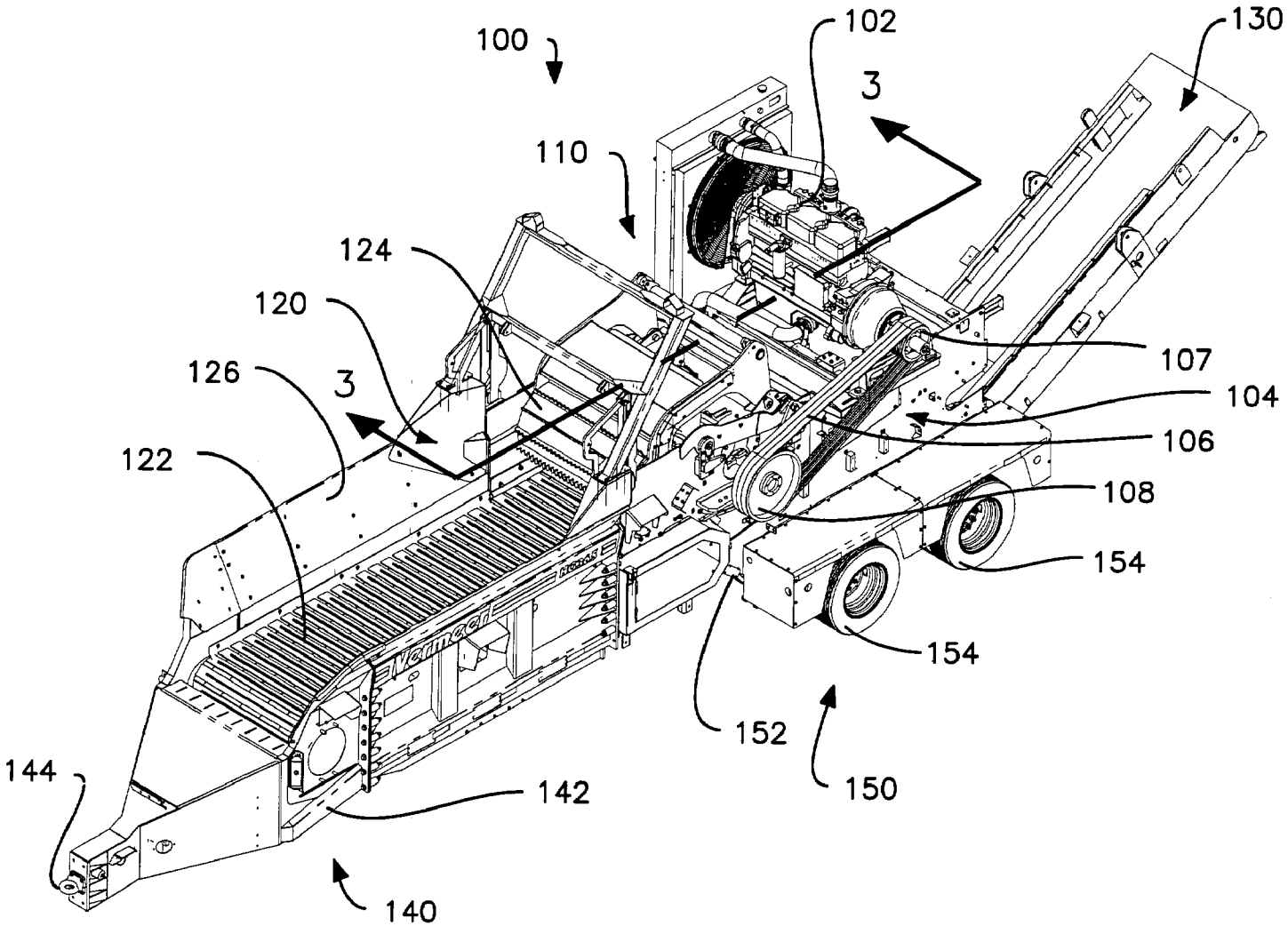
FIG. 1 is a perspective view of a horizontal grinder.

Referring now to the drawings wherein like reference numerals designate identical or corresponding parts throughout the several views, a horizontal grinder 100 is illustrated in FIG. 1. The horizontal grinder 100 illustrated in this embodiment includes a grinding unit 110, feed system 120 and discharge conveyor 130 mounted onto a frame 140 that is supported by ground support 150.

Many horizontal grinders are configured for mobile applications where the grinder is moved from one processing location to another. In the mobile configuration, the ground support 150 typically includes an axle 152 and wheels 154. Track units, either freely rotating tracks or powered tracks replace the wheels in some models of horizontal grinders.

In other configurations the machines are set-up for stationary applications, such as for use in a paper mill or land-fill, where the material can be delivered to the machine. In this configuration the wheels may be omitted, with the frame fixedly secured to a foundation. The ground support is not an element of the current invention.

The frame 140 is supported by the ground support 150 and includes side rails 142 and can include a hitch point 144. The hitch point 144 is adapted to cooperate with a towing vehicle, and may come any a variety of configurations.

Typically the opposite end of the frame 140 is adapted to support discharge conveyor 130.

Discharge conveyor 130 is adapted to accept ground material from the grinding unit 110 and transport it to a location as desired by the operator. This may include transportation to a further processing machine such as a trommel screen, or to a truck for transport, or to simply elevate the material to be dropped to create a pile.

Figure 2:
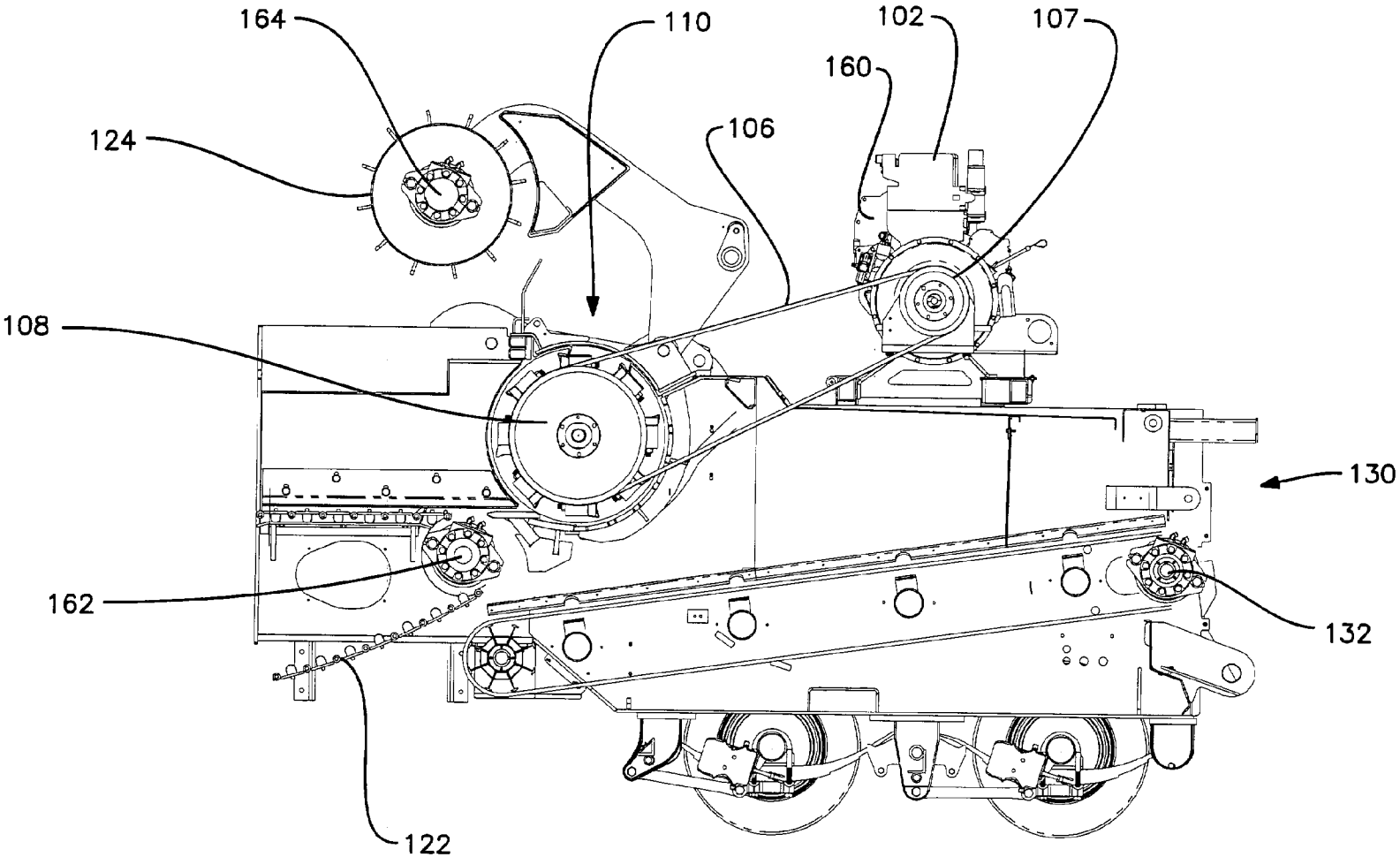
FIG. 2 is a schematic, a partial side elevation view of the horizontal grinder shown in FIG. 1.

The current invention involves the interaction of the grinding unit 110, feed system 120, and prime mover 102. The prime mover 102 is preferably mounted to the frame 140 and for mobile applications, preferably includes a diesel engine. Alternatively, the prime mover may be an electric motor. In either case the prime mover provides power to the grinding unit 110 and to the feed system 120. FIG. 2 illustrates the prime mover 102 providing power to the grinding unit 110 with drive belt 106 which is routed over drive pulley 107 and driven pulley 108. The prime mover 102 also provides power to hydraulic pump 160, which is capable of generating fluid power. The fluid power is transferred to a hydraulic motor 162 to power a feed conveyor 122, hydraulic motor 164 to power a feed roller 124 and hydraulic motor 132 to power the discharge conveyor 130. In stationary configurations, or those where electric power is readily available, the hydraulic motors 162, 164 and 132 could be replaced with electric motors.

In alternative embodiments, the feed roller can be replaced with other types of feed conveyors such as chain conveyors, belt conveyors or other structures. Also, while feed conveyor 122 is shown as a chain conveyor, other types of conveyors such as rollers, belt conveyors or other structures could also be used.

Figure 3:
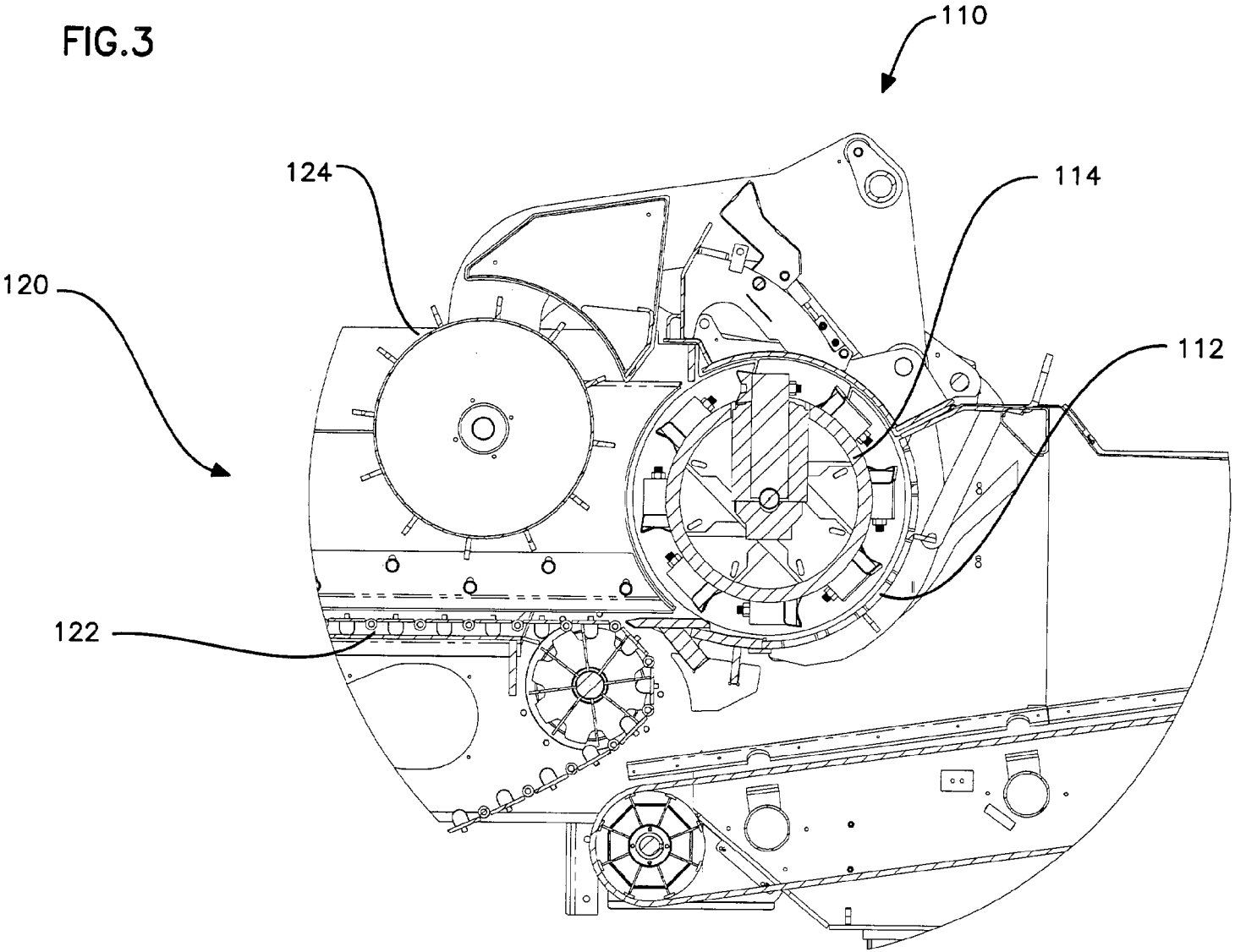
FIG. 3 is a partial sectional view taken along line 3—3 of FIG. 1 showing the grinding unit and a portion of the feed system of the horizontal grinder shown in FIG. 1.

The grinding unit 110 is illustrated in FIG. 3, and includes a grinding drum 114 and screens 112. An example of such a grinding drum can be found in U.S. Pat. No. 6,422,495 which is herein incorporated by reference. Other types of grinding members, rotors, plates, discs or other structures can also be used. The screens 112 are available in a variety of sizes and configurations, selected by the operator to achieve a desired size and quality of ground material. The selection of the screens will affect the performance of the machine. The configuration and configuration of the grinding drum 114 will likewise affect the performance of the machine.

The feed system 120 delivers material to be ground to the grinding unit 110. The interaction of the feed roller 124 and the feed conveyor 122 are effective in feeding a variety of materials to the cutting unit 110: the speed of the outer surface of the feed roller 124 as compared to the speed of the feed conveyor 122 affects the way material is fed. Preferably, the speed of feed roller 124 is controlled to be slightly faster than the speed of feed conveyor 122. This speed difference provides a more consistent feeding, and tends to reduce the potential for fluctuations in feed rate or plugging of the feed system.

Figure 4:
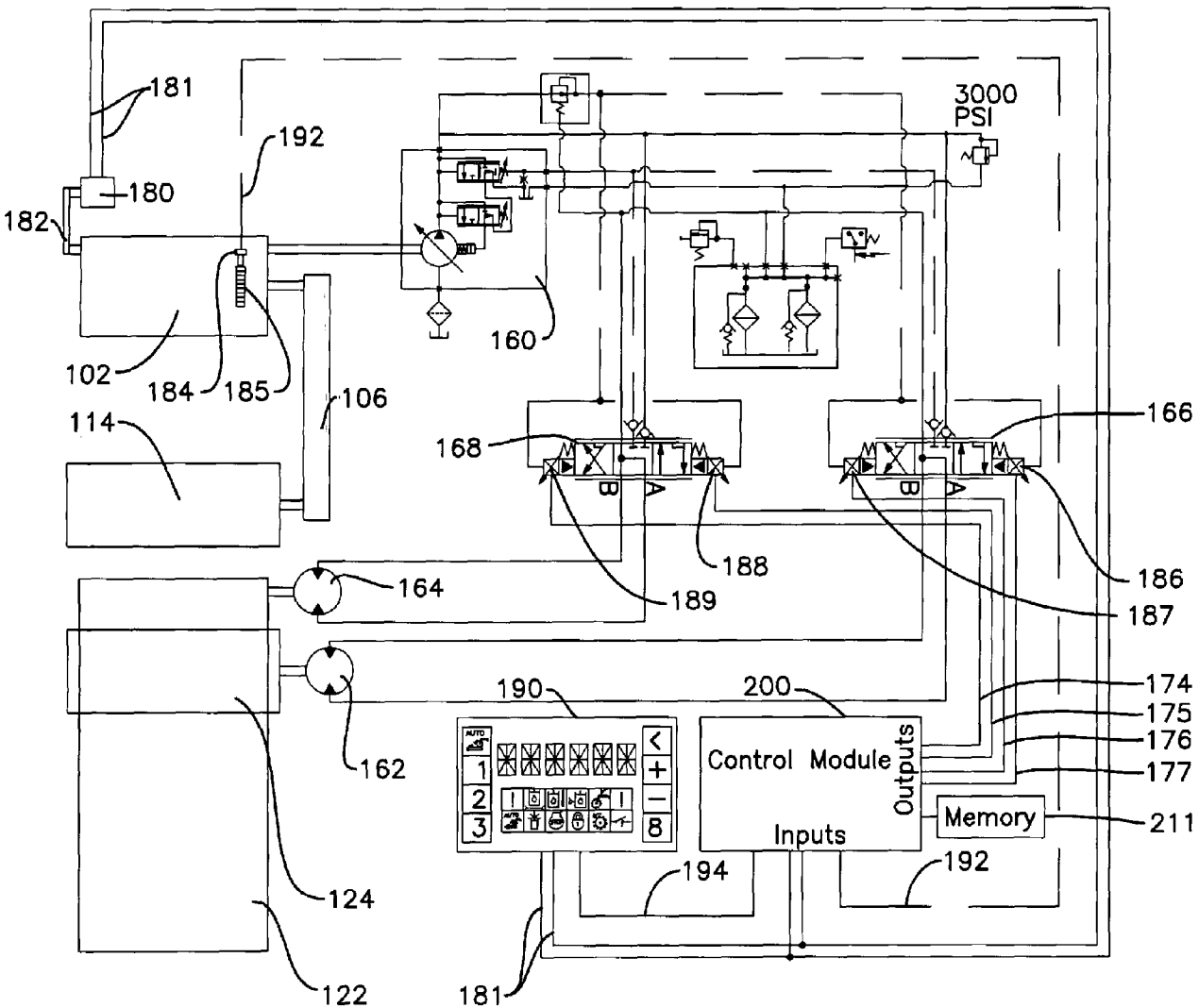
FIG. 4 is a schematic illustrating the mechanical drive to the grinding unit, the hydraulic system for driving the feed system and the electrical control system for a system utilizing pulse width modulated flow control to the feed system.

One embodiment of the hydraulic and electric control systems are illustrated schematically in FIG. 4. Prime mover 102 provides power to rotate the grinding drum 114 with drive belt 106, to rotate alternator 180 with drive belt 182 and power to drive pump 160. Pump 160 generates hydraulic fluid power, pressure and flow, that is supplied to feed conveyor flow control valve 166 and feed roller flow control valve 168. Valves 166 and 168 are directional and flow control valves which function to control the hydraulic fluid delivered to the feed roller motor 164 and the feed conveyor motor 162. They function identically, thus the function will be described for one, the feed roller flow control valve 168. An example control valve suitable for use as either of the valves 166, 168 includes a Gresen Model V20 solenoid-controlled directional control valve with a V20-EPC-I proportioned solenoid actuator. Gresen is owned by Parker Hannifin Corporation of Cleveland, Ohio.

Pulse width solenoids 188 and 189 control the hydraulic fluid output from valve 168. Only one of these solenoids is energized at any one time. If solenoid 188 is energized the hydraulic fluid will be delivered to motor 164 such that it rotates in a first direction. If solenoid 189 is energized, the motor 164 will rotate in the opposite direction.

Solenoids 188 and 189 and the associated valving are designed to respond to an electrical signal, typically in the form of a square wave fluctuating between an energized state at a set voltage and a deenergized state, with a certain frequency and duty cycle. The duty cycle is defined by looking at an individual period, with time duration equal to the inverse of the frequency. The duty cycle is the % of time of each period that the signal is energized. Thus if the duty cycle is 40%, then for 40% of each time period the signal will be energized and for 60% it will be deenergized. The controller 200 supplies this electrical signal: for solenoid 188 through electrical conductor 175 and for solenoid 189 through electrical conductor 174.

The result of supplying one of the solenoids 188 or 189 with a specific duty cycle will be that a controlled pilot pressure will be delivered to a main spool within valve 168 causing it to shift in a certain direction compressing a spring and thus shifting a set distance. The design of the main spool is such that this shift will result in hydraulic fluid being directed to motor 164 in a set direction, and with a controlled flow rate. This controlled flow rate will result in a set speed of rotation for the motor. If the duty cycle is 100% then the spool will be shifted fully, resulting in maximum flow rate, and maximum motor speed of rotation. If the duty cycle is less than 100%, then the flow rate will be reduced.

Control module 200 is adapted to provide the electrical signals to solenoids 186, 187, 188, and 189 with electrical conductors 174, 175, 176 and 177 to control the direction and speed of the feed system 120.

Figure 4A:
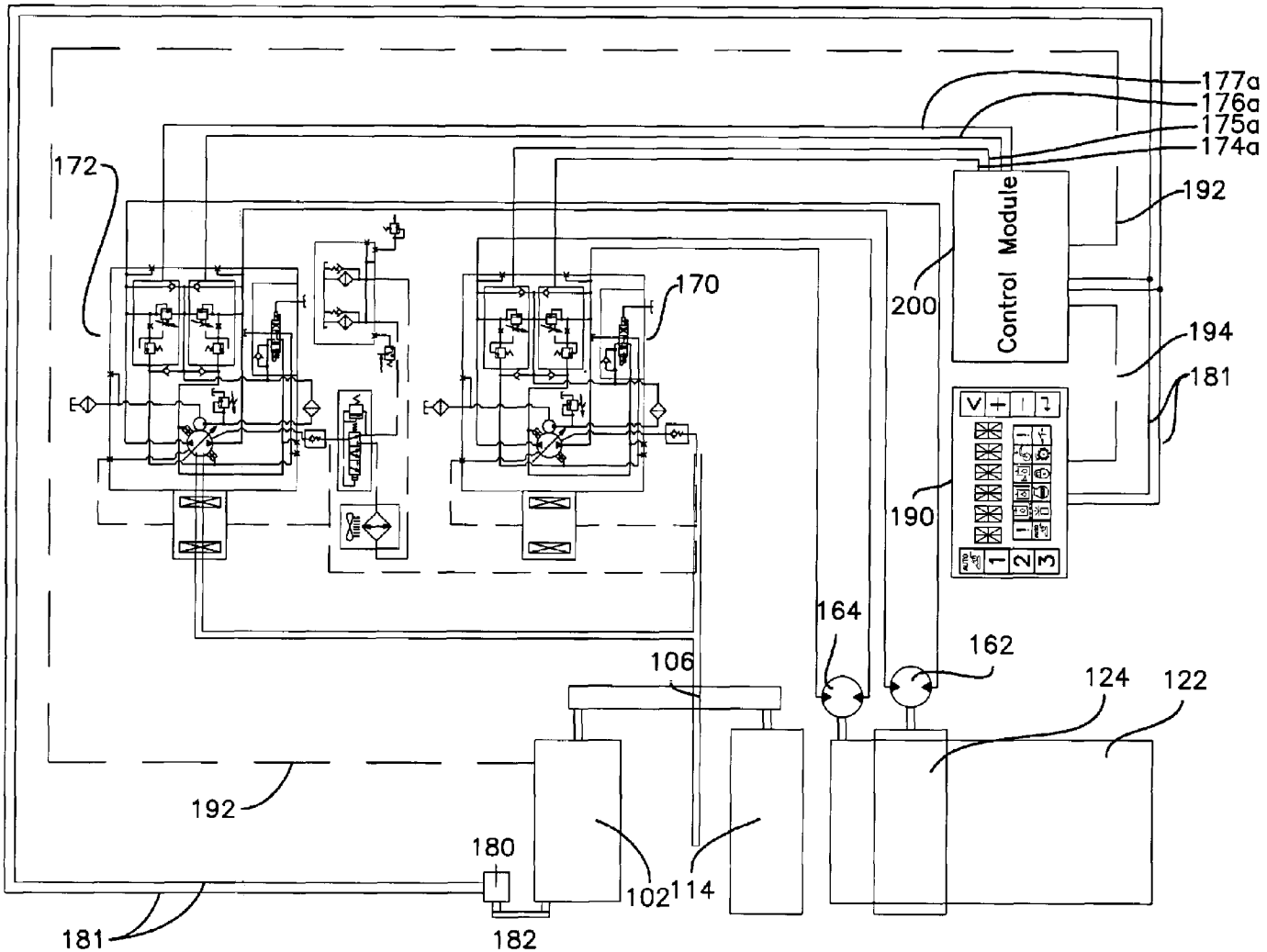
FIG. 4*a* is a schematic illustrating the mechanical drive to the grinding unit, the hydraulic system for driving the feed system and the electrical control system for a system utilizing hydrostatic drive system for the feed system.

An alternative embodiment of the hydraulic and electric control systems is illustrated schematically in FIG. 4*a*. Prime mover 102 provides power to rotate the grinding drum 114 with drive belt 106, to rotate alternator 180 with drive belt 182 and power to variable displacement drive pumps 170 and 172. Pump 170 generates hydraulic fluid power, pressure and flow, that is supplied to feed roller motor 164. Pump 172 generates hydraulic fluid power, pressure and flow, that is supplied to feed conveyor motor 162. Pumps 170 and 172 are variable displacement pumps, capable of producing flow in either direction and at variable flow rates, and the overall system is known as a hydrostatic system. For this embodiment the flow rates are related to the electrical amperage supplied to a control circuit in the pumps, as compared to the duty cycle for the embodiment of FIG. 4. In this way the embodiments are different. However, they are similar in that the flow rate and direction of the flow are controlled by electrical signals in electrical conductors 174*a*, 175*a*, 176*a* and 177*a* from control module 200.

The control module 200 is thus able to control the direction of rotation, and the speed of rotation of the feed roller 124 and of the feed conveyor 122 with its outputs. The inputs to controller 200 include a load signal from the prime mover 102 through electrical conductor 192, and a communication signal from operator controls 190 through communication link 194.

The load signal can be any of a number of signals including a speed signal if the prime mover is a diesel engine, or a measure of amperage draw if the prime mover is a motor. Other techniques of measuring load, particularly for a diesel engine are disclosed in U.S. Pat. No. 5,588,474 U.S. Pat. No. 5,845,689 and U.S. Pat. No. 6,014,996 which are herein incorporated by reference in their entireties.

For the embodiment illustrated in FIG. 4, assuming the prime mover is a diesel engine, the load signal can be generated by a simple speed sensor, as in an inductive sensor 184. Sensor 184 is positioned near to a gear 185 that is fixedly attached to the driveline such that it rotates with a speed directly proportional to the speed of the engine. As the gear 185 rotates, it will produce a signal each time that a gear tooth passes near the sensor 184. The speed of rotation can then be calculated by measuring the frequency of the signal. Controller 200 can calculate the speed of the engine from this measurement. Controller 200 includes programming to maximize the productivity of the grinding machine using this measurement. The rotational speed of the drum can also be used to indicate the loading on the power source.

The overall performance of the machine is determined by the capability of the feed system 120 to deliver material to the cutting unit 110. The normal goal is to maximize productivity. It can be assumed that maximum productivity occurs at the time that the prime mover is delivering maximum power.

Figure 5:
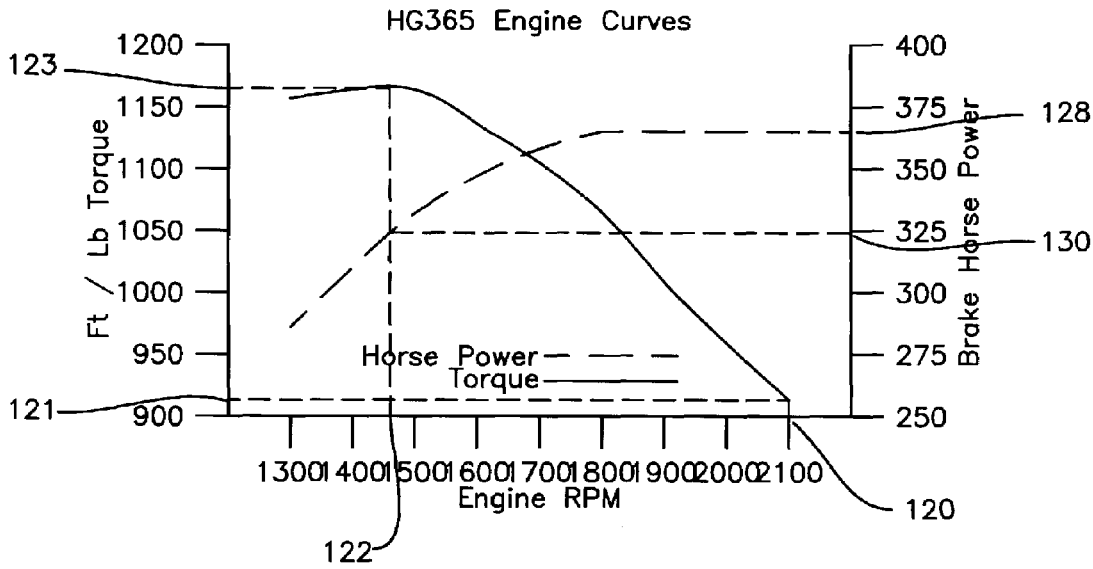
FIG. 5 is a characteristic maximum torque and maximum power curve for a diesel engine of a first model of a Horizontal grinder.
Figure 5A:
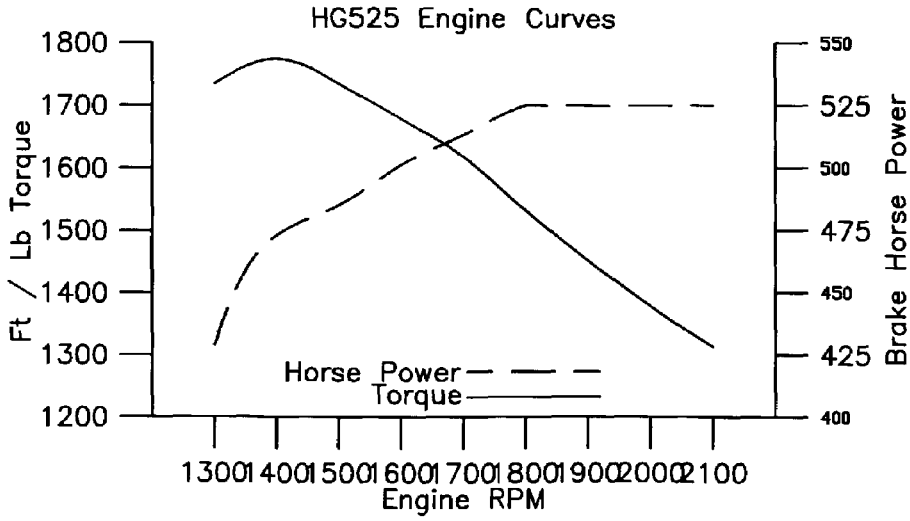
FIG. 5*a* is a characteristic maximum torque and maximum power curve for a diesel engine of a second model of a Horizontal grinder.

The prime mover (102) of a horizontal grinder constructed for mobile applications will typically be a diesel engine. Each model of such diesel engine will typically have known performance characteristics. One measurement of a diesel engine's performance characteristic is its torque curve; FIGS. 5 and 5*a* illustrate examples of engine performance curves for 2 different diesel engines. In the example of FIG. 5 the engine, operating at high idle, corresponding to engine speed (120), will be capable of generating a maximum torque (121). If horizontal grinder (100) were being operated with prime mover (102) at high idle, with grinding drum (114) freely rotating at its corresponding speed, and no material being fed, the torque will be approximately zero. As the feed system (120) is engaged and begins to feed material, the prime mover (102) will increase its power generation by increasing the rate fuel is delivered, to increase the torque, as necessary to provide the grinding force, while maintaining the speed (120). Once the torque reaches torque (121) the engine speed will begin to decrease due to the characteristics of the fuel delivery system, while the torque will continue to increase to a maximum torque (123) which occurs at engine speed (122). Once the engine speed drops below (122), the maximum torque begins to decrease. The resulting characteristics are such that as long as the engine speed is maintained between (122) and (120) the torque will increase as speed decreases, and the engine has relatively good operating stability. However, if the engine speed drops below (122), the torque will decrease as speed decreases and the engine can be more easily stalled.

When the prime mover comprises an internal combustion engine, there is a preferred operating range, which corresponds to engine speed between (120) and (122). In this manner the speed of the engine, or any parameter directly correlating to the speed of the engine, can be monitored to approximate loading: if the engine speed is below high idle (120) and above the maximum torque speed 122, the loading is approximately maximized. In this preferred embodiment illustrated in FIG. 4 the speed sensor 184 is utilized to provide a measurement of the speed of the prime mover 102, a diesel engine. The feed system 120 is subsequently controlled by controller 200 to achieve a condition where the loading of the engine is in the preferred operating range, where the loading is near maximum.

FIGS. 6*a*–6*h* illustrate static state control curves used by controller 200 to determine the duty cycle of electrical signals (i.e., pulse width modulated signals) provided to one of the solenoids of valves 168 and 166. It is preferred for the operator to select different control curves or to vary the settings of the control curves in accordance with the type of material being processed. For example, in one embodiment, the operator can set the 'Duty Cycle' and 'Autofeed Droop' at a variety of settings. In the embodiment of FIG. 4, operator input regarding the control curves can be provided through operator controls 190. The data relating to the control curves is preferably saved in memory 211 that can be accessed by the controller 200.

The static state control curves illustrate how the duty cycle, as described previously, supplied to a solenoid 186, 187, 188 or 189 is varied in response to variations in the engine speed, if the loading is such that the engine speed variations are relatively stable, if the speed is not changing quickly. The dynamic response of the control algorithm will be defined by the type of control technique selected. An example of a predictive technique is disclosed in U.S. patent application Ser. No. 10/001,509, which is hereby incorporated by reference in its entirety. The operator is preferably able to adjust the 'Duty Cycle' which affects the maximum duty cycle applied to a solenoid, and the 'Autofeed Droop' the engine rpm where the duty cycle is set to zero, effectively stopping the feed system.

Figure 6A:
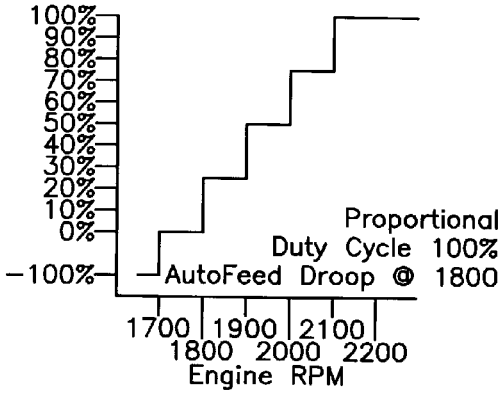
FIG. 6*a*–6*h* are control curves, for control of the signal to the pulse width modulated solenoids of FIG. 4, based on speed of a diesel engine.
Figure 6B:
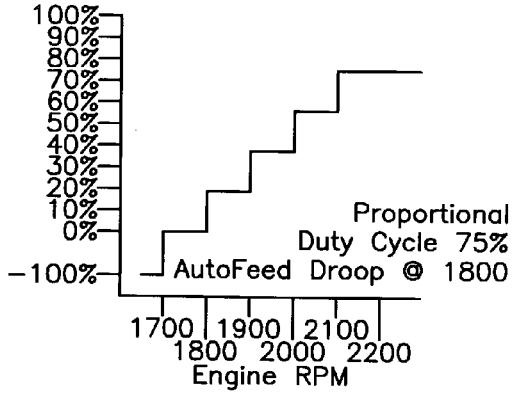
Figure 6C:
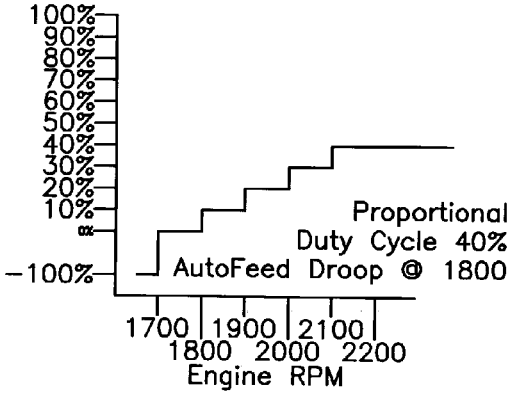
Figure 6D:
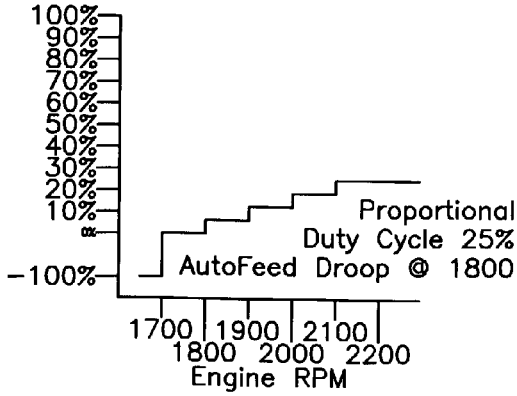
Figure 6E:
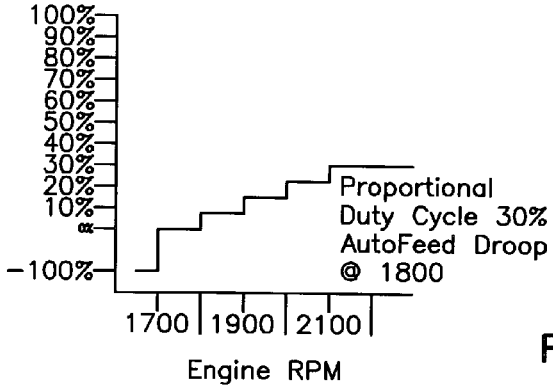
Figure 6F:
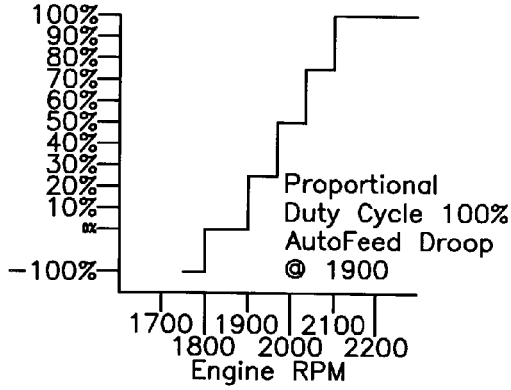
Figure 6G:
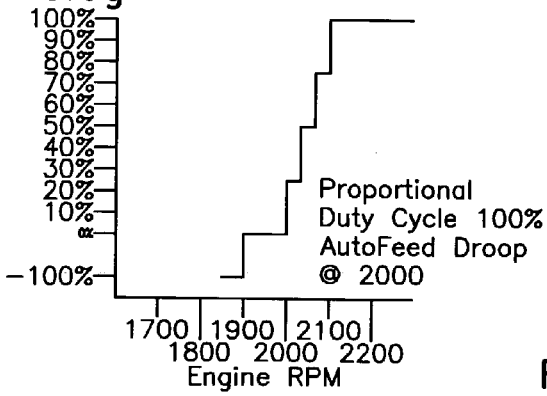
Figure 6H:
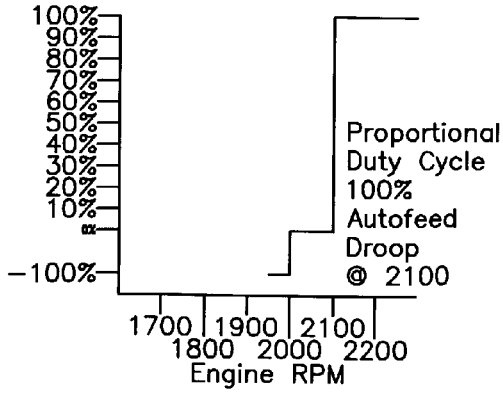

A preferred embodiment, defined by the settings which have been determined to be the most versatile, is illustrated in FIG. 6*c* for the control of the feed roller 124 and FIG. 6*e* for the control of the feed conveyor 122. In both of these figures the duty cycle is at its maximum when the engine speed exceeds 2100, 40% for the feed roller and 30% for the feed conveyor. The duty cycle is decreased at steps when the engine speed drops below 2100, 2000, 1900 and set to 0 when the engine speed drops below 1800. At this point the feed roller and the feed conveyor will be stationary, not feeding. If the engine speed were to continue dropping, an additional 100 rpm to 1700 rpm, then the other solenoid is energized at 100% duty cycle to reverse the feed. For instance if solenoid 188 is the forward feed solenoid for the feed roller in FIG. 4, it will be operated as illustrated in FIG. 6*c* when the engine rpm is above 1800 rpm. If the engine rpm drops below 1700 rpm, then solenoid 189 will be energized at 100% duty cycle to reverse the feed.

The feed system will be reversed, as illustrated in FIGS. 6*a*–6*h* whenever a negative duty cycle occurs. This reversal may be applied for a set period of time, or may be applied until the engine rpm increases to above the rpm equal to the Autofeed droop setting minus 100 rpm, which corresponds to 1700 rpm in FIGS. 6*c* and 6*e*.

The 'Duty Cycle' and the 'Autofeed Droop' can be adjusted by an operator so that they can be tailored to the specific type of material, and to a specific engine's characteristics. The 'Duty Cycle' can be set for the feed roller independent of the feed conveyor, allowing the two feed elements to be operated at a variety of speeds. The 'Autofeed Droop' is the same for both the feed roller and the feed conveyor control curves.

The curves provide a stepped function. It has been found that this stepped function provides more reliable performance of the pulse width modulated valves, also known as proportional control valves, and is particular to use with proportional control valves. The characteristic of pulse width modulated valves is such that there is inherent hystersis, resulting in a difficulty to consistently make small corrections. It has been found that this stepped function gives adequate speed control. The stepped function illustrated is a static curve, defining the appropriate duty cycle applicable to a specific static loading condition. The actual algorithm used to implement this function may cause the duty cycle applied to the solenoid driving the feed conveyor, for the curve illustrated in FIG. 6*c*, to transition from the initial duty cycle of 30% directly to 0%, if the rate of deceleration is sufficient to suggest that need. However, if the loading is such that the deceleration is more gradual the control may apply each of the illustrated steps.

If the controller were being utilized to control the hydraulic system of FIG. 4A the control signal would be supplied to the variable displacement pump, and the curve could be linear rather than stepped. The variable displacement pumps offer an advantage of being able to adequately control flow rates by linearly controlling the amperage rather than the preferred embodiment of controlling the duty cycle in a stepped function for the proportional control valves. If proportional valves exhibiting adequate dynamic response characteristics are identified and utilized a linear function could also be utilized in conjunction with the hydraulic system of FIG. 4, rather than the stepped function previously described.

Figure 7A:
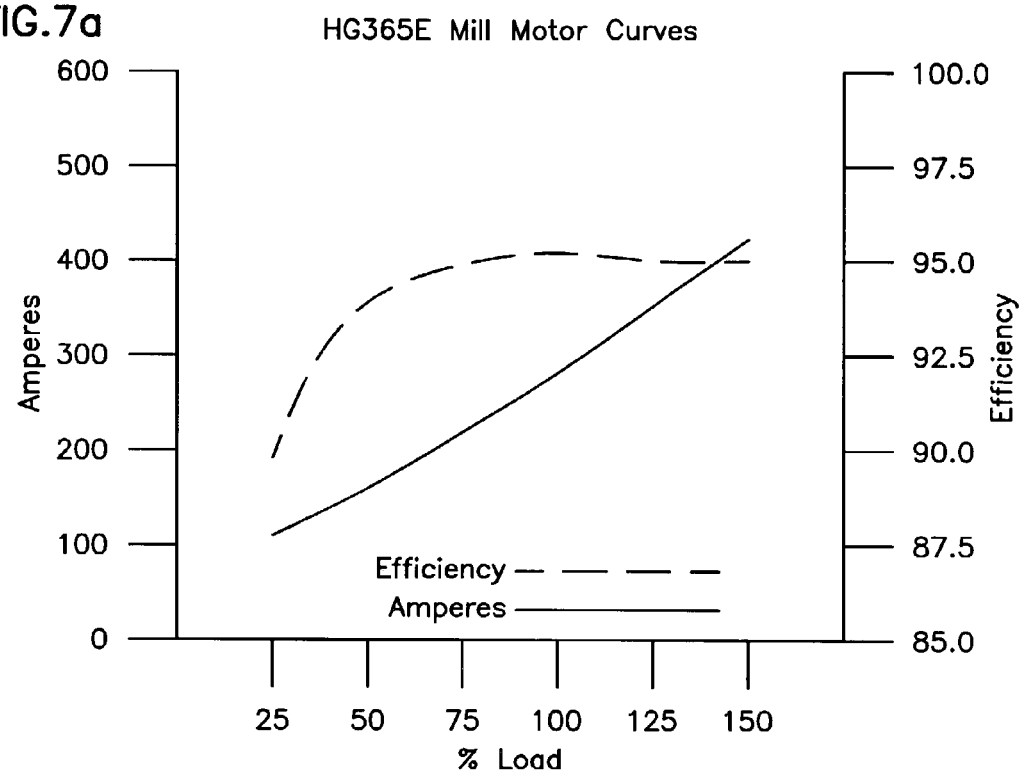
FIG. 7*a* is a characteristic power and efficiency curve for a motor of a first model of a horizontal grinder.
Figure 7B:
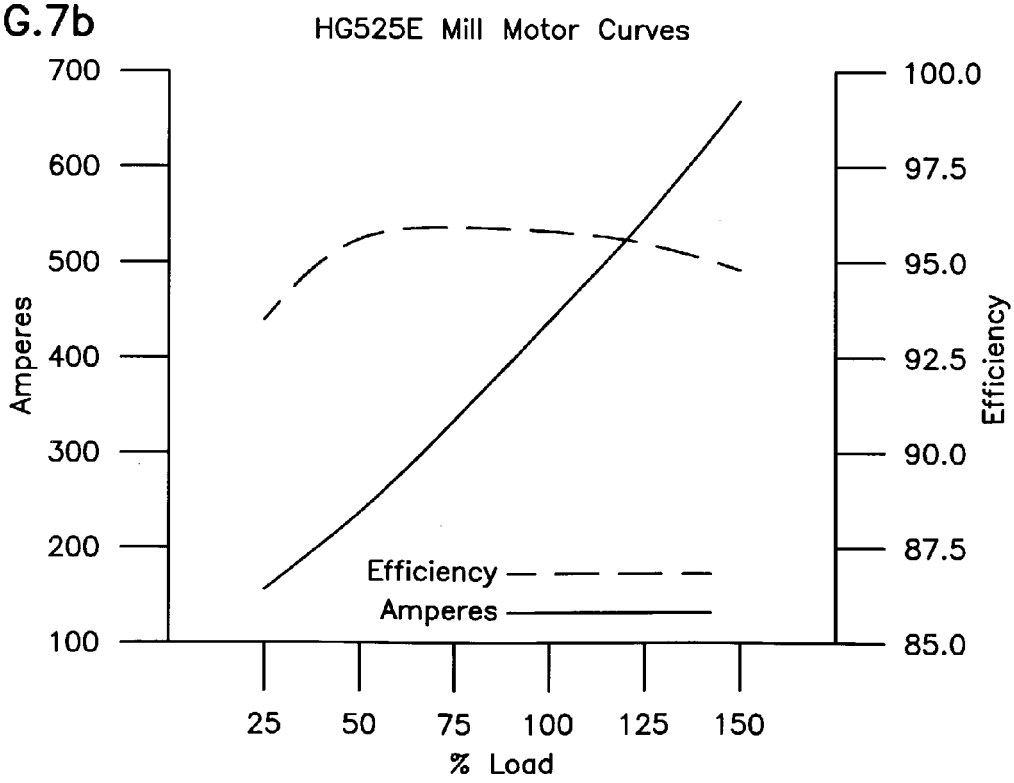
FIG. 7*b* is a characteristic power and efficiency curve for a motor of a first model of a horizontal grinder.
Figure 8A:
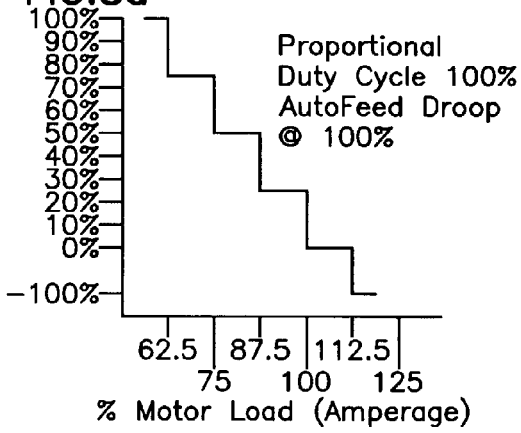
FIG. 8*a*–8*h* are control curves, for control of the signal to the pulse width modulated solenoids of FIG. 4, based on electric motor loading.
Figure 8B:
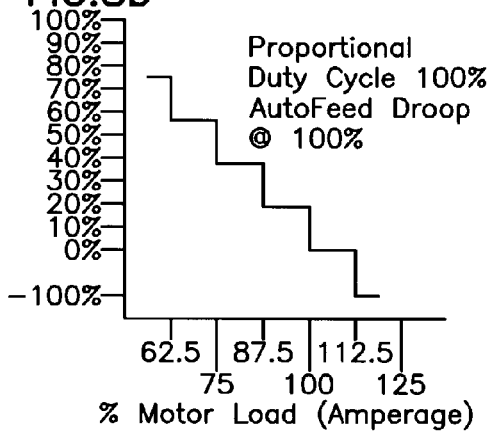
Figure 8C:
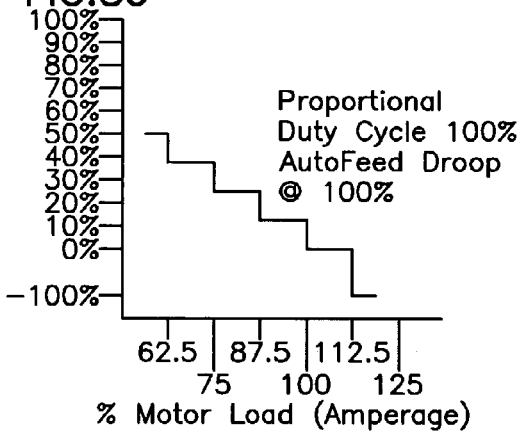
Figure 8D:
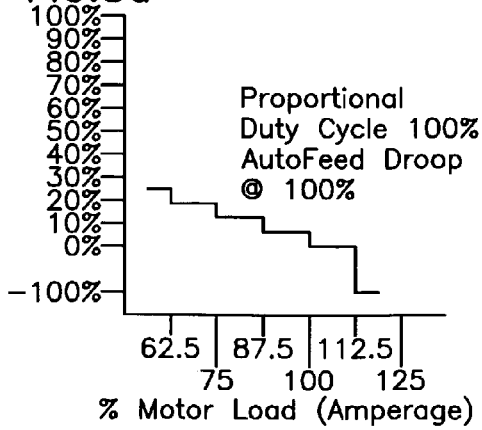
Figure 8E:
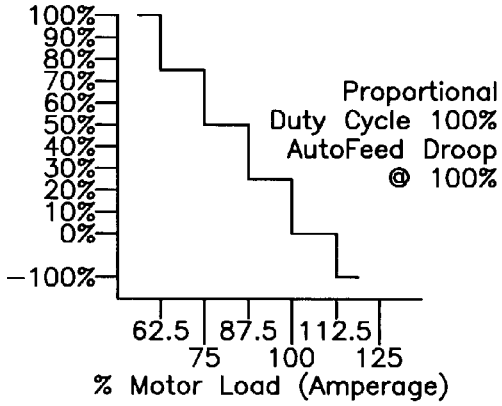
Figure 8F:
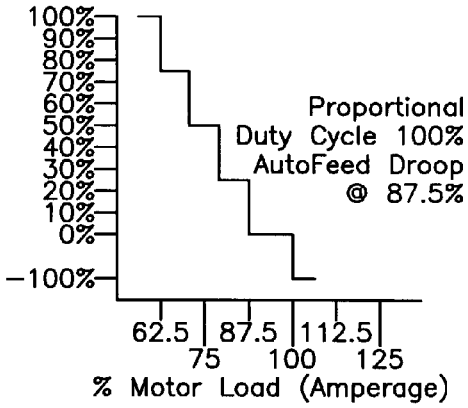
Figure 8G:
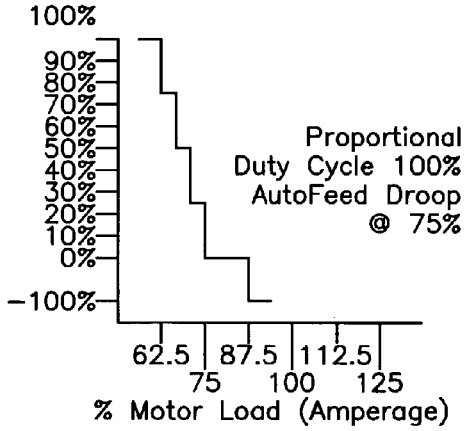
Figure 8H:
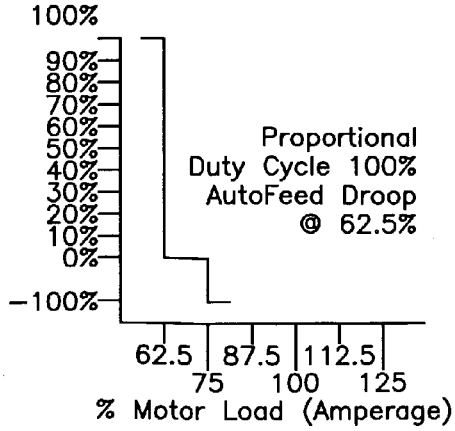

If the prime mover of FIG. 4 were an electric motor the load signal transferred through electrical conductor 192 would be an indication of amperage draw. This is a direct measurement of the power being provided to the horizontal grinder 100. The motor installed on the horizontal grinder 100 as the prime mover 102 will have performance characteristics as illustrated in FIGS. 7*a* and 7*b*. These figures illustrate that the motor's efficiency improves if the loading is kept above approximately 50%. It is felt there is an optimum load range between 60% and 100% loading.

FIGS. 8*a*–8*h* illustrate static control curves provided by controller 200 for a configuration of the horizontal grinder 100 with prime mover 102 comprising an electric motor, and proportional valves controlling the feed system, as illustrated in FIG. 4. These curves illustrate the preferred control characteristics with the variable 'Duty Cycle' and 'Autofeed Droop' at a variety of settings. In each the feed system is operated at its maximum speed, as defined by the 'Duty Cycle' setting, whenever the motor loading is less than 62.5%. When the loading exceeds 62.5% the speed of the feed system is reduced, in 4 even steps, until it has been stopped at a loading condition as set by the 'Autofeed Droop' setting. Here again the dynamic response of the control system will be defined by the control algorithm, and may result a duty cycle, applied to the driving solenoids, transitioning such that some of these 4 even steps are bypassed. Alternatively, if the proportional valves exhibit adequate dynamic response characteristics, or if the hydraulic system illustrated in FIG. 4*a* is being controlled, a linear function can be utilized, rather than this stepped function.

The feed system will be reversed whenever the loading exceeds the 'Autofeed Droop' plus 12.5%, or 112% if the 'Autofeed Droop' is set at 100%. This reversal may occur for a predetermined time period, or may be maintained until the loading condition drops such that the load is below the 'Autofeed Droop' setting.

The operator is able to control the settings of the 'Autofeed Droop' and 'Duty Cycle' in order to tailor the machine's operating characteristics as may be necessary for the different type of products that are being ground.

With the system herein described the horizontal grinder's feed system is operated in a manner to enable the operator to maximize the productivity of the horizontal grinder.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A horizontal grinder comprising:

a grinding structure;

upper and lower feed conveyors for feeding material toward the grinding structure, the upper feed conveyor being positioned above the lower feed conveyor such that the material fed toward the grinding structure travels between the upper and lower feed conveyors;

a power source for rotating the grinding structure, the power source defining an operating characteristic when generating power to rotate the grinding structure; and a controller which controls the speed of the lower and upper feed conveyors in proportion to the operating characteristic of the power source;

wherein the upper feed conveyor is controlled by first pulse-width modulated signals generated by the controller, and the lower feed conveyor is controlled by second pulse-width modulated signals generated by the controller, the first signals and the second signals having different duty cycles.

2. The grinder of claim 1, wherein the operating characteristic of the power source includes speed.

3. The grinder of claim 1, wherein the operating characteristic of the power source include amperage draw.

4. The grinder of claim 1, wherein the operating characteristic of the power source includes loading.

5. The grinder of claim 1, wherein the upper feed conveyor includes a feed roller.

6. The grinder of claim 5, wherein the lower feed conveyor includes a chain conveyor.

7. The grinder of claim 1, wherein the upper and lower feed conveyors both drive the material toward the grinding structure, and wherein the upper feed conveyor drives the material at a faster speed than the lower conveyor.

8. The grinder of claim 1, further comprising memory in which first and second different control curves are stored, wherein the controller uses the first control curve to control the upper feed conveyor and the second control curve to control the lower feed conveyor.

9. The grinder of claim 8, wherein the first and second control curves are stepped duty cycle to power source characteristic curves.

10. The grinder of claim 9, wherein each of the first and second control curves includes at least 4 steps.

11. The grinder of claim 1, wherein the controller is connected independently to each of said lower and upper feed conveyors whereby the speed of said lower and upper feed conveyors are operated independently.

12. The grinder of claim 1, wherein said power source includes an internal combustion engine.

13. The horizontal grinder of claim 1, wherein said power source includes an electric motor.

14. A horizontal grinder comprising:

a grinding structure;

upper and lower feed conveyors for feeding material toward the grinding structure, the upper feed conveyor being positioned above the lower feed conveyor such that the material fed toward the grinding structure travels between the upper and lower feed conveyors;

first and second hydraulic motors for driving the upper and lower feed conveyors, respectively;

pulse-width modulated control valves for controlling fluid flow to the first and second hydraulic motors;

a power source for rotating the grinding structure;

a controller which controls the speed of the lower and upper feed conveyors by sending pulse-width modulated signals to the pulse-width modulated control valves; and memory in which first and second different stepped, pulse-width control curves are stored, wherein the controller uses the first control curve to determine the pulse-width modulated signals for controlling the speed of the upper feed conveyor, and the controller uses the second control curve to determine the pulse-width modulated signals for controlling the speed of the lower feed conveyor.

15. The grinder of claim 14, wherein the first and second pulse-width curves include duty cycle to power source operating characteristic curves.

16. The grinder of claim 15, wherein each of the first and second curves includes at least 4 steps.

17. A method of using a horizontal grinder of a type having, a frame, a grinding rotor operatively rotatably attached to the frame, a chamber for receiving material to be ground into small pieces, a lower feed conveyor forming a floor to said chamber, one end of said lower feed conveyor being disposed adjacent to said rotor, an upper feed conveyor disposed in said chamber above said one end of the lower feed conveyor for cooperating with said lower feed conveyor to move said material from the chamber to the rotor, and a power source operatively attached to said grinding rotor, said method comprising:

rotating the grinding rotor using the power source;

moving the lower and upper conveyors in a direction to cause the material to be ground to move toward said grinding rotor; and causing said upper and lower feed conveyors to move toward said grinding rotor in proportion to the load on the power source while the power source is generating power to rotate the grinding rotor, said upper feed conveyor moving in response to first control signals, said lower feed conveyor moving in response to second control signals, said first control signals and the second control signals having different duty cycles.

18. A horizontal grinder comprising:

a grinding structure;

upper and lower feed conveyors for feeding material toward the grinding structure, the upper feed conveyor being positioned above the lower feed conveyor such that the material fed toward the grinding structure travels between the upper and lower feed conveyors;

a power source for rotating the grinding structure, the power source defining an operating characteristic when generating power to rotate the grinding structure;

a controller which controls the speed of at least one of the lower and upper feed conveyors in proportion to the operating characteristic of the power source; and memory in which first and second different control curves are stored, wherein the controller uses the first control curve to control the upper feed conveyor and the second control curve to control the lower feed conveyor.

19. The grinder of claim 18, wherein the first and second control curves are stepped duty cycle to power source characteristic curves.

20. The grinder of claim 19, wherein each of the first and second control curves includes at least 4 steps.

21. The method of claim 17, wherein the first and second control signals that cause said upper and lower feed conveyors to move toward said grinding rotor are pulse-width modulated signals.

22. A horizontal grinder comprising:

a grinding structure;

upper and lower feed conveyors for feeding material toward the grinding structure, the upper feed conveyor being positioned above the lower feed conveyor such that the material fed toward the grinding structure travels between the upper and lower feed conveyors;

a power source for rotating the grinding structure, the power source defining an operating characteristic when generating power to rotate the grinding structure; and a controller which controls the speed of the lower and upper feed conveyors in proportion to the operating characteristic of the power source;

wherein the upper feed conveyor is controlled by first control signals generated by the controller, and the lower feed conveyor is controlled by second control signals generated by the controller, the first signals and the second signals having different duty cycles.

23. A horizontal grinder comprising:

a grinding structure;

upper and lower feed conveyors for feeding material toward the grinding structure, the upper feed conveyor being positioned above the lower feed conveyor such that the material fed toward the grinding structure travels between the upper and lower feed conveyors;

first and second hydraulic motors for driving the upper and lower feed conveyors, respectively;

a power source for rotating the grinding structure;

a controller which controls the speed of the lower and upper feed conveyors by generating electrical signals;

memory in which first and second different control curves are stored, wherein the controller uses the first control curve to determine the electrical signals for controlling the speed of the upper feed conveyor, and wherein the controller uses the second control curve to determine the electrical signals for controlling the speed of the lower feed conveyor; and variable control valves that control fluid flow to the first and second hydraulic motors in response to receipt of the electrical signals generated by the controller.

* * * * *